US008322844B2

(12) United States Patent
Toya

(10) Patent No.: US 8,322,844 B2
(45) Date of Patent: Dec. 4, 2012

(54) RECORDING APPARATUS

(75) Inventor: Akihiro Toya, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 265 days.

(21) Appl. No.: 12/766,235

(22) Filed: Apr. 23, 2010

(65) Prior Publication Data

US 2010/0271453 A1 Oct. 28, 2010

(30) Foreign Application Priority Data

Apr. 24, 2009 (JP) ..... 2009-106380

(51) Int. Cl.
*B41J 2/01* (2006.01)

(52) U.S. Cl. ..... 347/104

(58) Field of Classification Search ..... 347/9, 14, 347/16, 20, 101, 102, 104, 105
See application file for complete search history.

(56) References Cited

U.S. PATENT DOCUMENTS 5,673,074 A 9/1997 Miyauchi et al.
7,222,926 B2 * 5/2007 Kojima ..... 347/8
2007/0126838 A1 * 6/2007 Tatsumi ..... 347/104
2008/0079770 A1 * 4/2008 Sloan et al. ..... 347/29
2008/0265496 A1 10/2008 Kawaguchi et al.

FOREIGN PATENT DOCUMENTS

| | | |
|---|---|---|
| JP | 04-105969 | 4/1992 |
| JP | 04-129769 | 4/1992 |
| JP | 08-224921 | 9/1996 |
| JP | 10-226119 | 8/1998 |
| JP | 2008-273002 | 11/2008 |

* cited by examiner

*Primary Examiner* — Stephen Meier
*Assistant Examiner* — Tracey McMillion
(74) *Attorney, Agent, or Firm* — Workman Nydegger

(57) ABSTRACT

A recording apparatus includes a recording head for performing a recording operation by ejecting ink onto a recording surface of a recording medium while moving; a transport section for transporting the recording medium along a transporting path that passes through a recording region in which the recording head performs the recording operation; a platen located in the recording region for supporting a surface opposite the recording surface of the recording medium; and pressing members located in the recording region and being in contact with outer edge portions in a width direction of the recording surface of the recording medium; wherein the pressing members move so as to press the recording medium at an upstream side and at a downstream side of the recording head, with a movement of the recording head.

12 Claims, 7 Drawing Sheets

RECORDING APPARATUS

BACKGROUND

1. Technical Field

The present invention relates to a recording apparatus for performing a recording operation, in a state where curling of a recording medium is corrected and the recording medium is made to be flat.

2. Related Art

In some recording apparatuses such as an ink jet printer, in order to accelerate drying of ink ejected onto a recording surface of a recording medium, a heater is provided for a platen that supports the recording medium and defines a gap between the recording medium and a recording head. In the case that a recording apparatus includes such a platen with a heater, conductive heat of the platen may bring about curling of the recording medium. As the curling of the recording medium, two kinds of curling occur. One is curling in a convex form, that is, the middle portion in the width direction of the recording medium is lifted up. The other is curling in a concave form, that is, both side edge portions in the width direction of the recording medium are lifted up.

Moreover, in some recording apparatuses, in order to forcibly correct the curling of the recording medium, a large number of suction holes are formed in the platen. In this case, by suction force generated by a suction section such as a suction fan provided outside, the recording medium is made to be in close contact with an upper surface of the platen. However, when the curling in the concave form occurs in the recording medium, the suction force does not efficiently act on the edge portions of the recording medium which are curled. Accordingly, there are cases in which the curling is not corrected sufficiently.

On the other hand, in a recording apparatus disclosed in JP-A-8-224921, spurs for preventing a recording medium from being lifted up after recording are provided, with respect to a carriage that scans a recording head in a direction perpendicular to a transport direction of the recording medium. In such a recording apparatus, a pair of spurs is provided at a downstream side of the recording head. By pinching the recording medium with sheet discharge rollers provided under the spurs and the spurs, both an operation of discharging the recording medium and an operation of preventing a rear edge of the recording medium from being lifted up are performed after recording.

However, in the case that the spurs disclosed in JP-A-8-224921 are used, because of the structure of the recording apparatus, the spurs pass through a recording surface of the recording medium. Therefore, there are cases in which the recording surface of the recording medium is damaged. In addition, since positions in which the spurs are provided are portions in which the sheet discharge rollers are provided at the downstream side of the recording head, there are cases where curling (lifting) of the recording medium is not corrected in a recording position in which a recording operation is performed by ejecting ink.

SUMMARY

An advantage of some aspects of the present invention is that it is possible to perform a recording operation over a recording surface of a recording medium in a state in which curling of the recording medium is corrected to a greater degree than was possible with the related art.

According to a first aspect of the invention, a recording apparatus includes: a recording head for performing a recording operation by ejecting ink onto a recording surface of a recording medium while moving; a transport section for transporting the recording medium along a transporting path that passes through a recording region in which the recording head performs the recording operation; a platen located in the recording region for supporting a surface opposite the recording surface of the recording medium; and pressing members located in the recording region and being in contact with outer edge portions in a width direction of the recording surface of the recording medium; the pressing members moving so as to press the recording medium at an upstream side and at a downstream side of the recording head, with a movement of the recording head.

In this case, the recording operation is performed by moving the recording head with respect to the recording medium supported by the platen. In other words, it is configured that the recording operation is performed on the recording medium while the recording head moves in the recording region. Moreover, the pressing members are in contact with the outer edge portions in the width direction of the recording surface of the recording medium that reaches the recording region. Furthermore, the pressing members move so as to press the recording medium at the upstream side and at the downstream side of the recording head, with the movement of the recording head. Therefore, a portion of the recording medium facing the recording head is always pressed by the pressing members. Accordingly, curling is corrected and the recording medium is held flat in the portion of the recording medium facing the recording head. Consequently, it is possible to perform the recording operation with high precision over the entire recording surface of the recording medium.

Further, when the outer edge portion serves as a margin that is not used for performing the recording operation, the pressing members are in contact with the margin only. Therefore, contact traces caused by the pressing members are not left on the recording surface after recording.

According to a second aspect of the invention, in the recording apparatus according to the first aspect, it is preferable that the recording head be held by a carriage that reciprocates in a transport direction of the recording medium, and the pressing members be provided near the recording head at least two positions, an upstream position and a downstream position in the transport direction of the recording medium.

In this case, the pressing members are provided with respect to the carriage, therefore, it is not necessary to provide the pressing members in a narrow gap between the recording head and the platen. Consequently, this reduces a restriction on design of both the structure for the arrangement of the pressing members and the size of the pressing members. Accordingly, the degree of freedom in the design and the cost performance are improved.

According to a third aspect of the invention, in the recording apparatus according to the second aspect, it is preferable that the pressing members be held by the carriage and be in contact with the recording medium by a force smaller than a force for supporting a weight of the carriage.

In this case, an amount of a pressing force for correcting curling of the recording medium is sufficient for an amount of a pressing force of the pressing members. Therefore, the amount of the force for supporting the weight of the carriage is not needed. Accordingly, when the pressing members move while being in contact with the recording medium, the contact resistance is suppressed to a low value, therefore, the contact resistance is not increased. Consequently, stability of the position of the recording head can be maintained.

Here, it is possible that the pressing members are configured so that positions thereof can be changed in the width direction of the recording medium corresponding to differences in a width of the recording medium. In this way, the pressing members can cope with a recording medium of various sizes in the width direction. Therefore, the effect of the pressing members can be obtained for a recording medium of various sizes in the width direction.

According to a fourth aspect of the invention, in the recording apparatus according to any one of the first to third aspects, it is preferable that the pressing members serve as rotation bodies that rotate in contact with the outer edge portion of the recording medium. In this case, since the pressing members serve as the rotation bodies that rotate in contact with the outer edge portion of the recording medium, it is possible to reduce frictional resistance generated at a portion where the pressing members are in contact with the recording medium. Therefore, the recording medium is smoothly transported and the carriage is smoothly reciprocated.

According to a fifth aspect of the invention, in the recording apparatus according to the fourth aspect, it is preferable that the rotation bodies be configured to be capable of adjusting the rotation speeds thereof so that the rotation bodies on a front side in an advancing direction of the carriage rotate later and the rotation bodies on a rear side rotate earlier. In this case, a state in which the recording medium is under tension is promoted between the rotation bodies provided at the upstream position near the recording head and the rotation bodies provided at the downstream position near the recording head. Therefore, the quality of the recording operation is improved by reducing the degree of curling generated in the recording medium.

According to a sixth aspect of the invention, in the recording apparatus according to any one of the first to fifth aspects, it is preferable that the platen include a suction mechanism for sucking and holding the recording medium that reaches the recording region.

In this case, in addition to the pressing force of the pressing members, a suction force by the suction mechanism acts on the recording medium from an opposite side, so that the curling of the recording medium is corrected more firmly. Therefore, the quality of the recording operation is further improved.

According to a seventh aspect of the invention, in the recording apparatus according to any one of the first to sixth aspects, it is preferable that the pressing members include a vibration proof mechanism that prevents transmission of vibration from a side of the recording medium to a side of a recording head.

In this case, the transmission of vibration to the recording head is prevented in a state in which the curling of the recording medium is corrected by the pressing members. Therefore, the quality of the recording operation is further improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
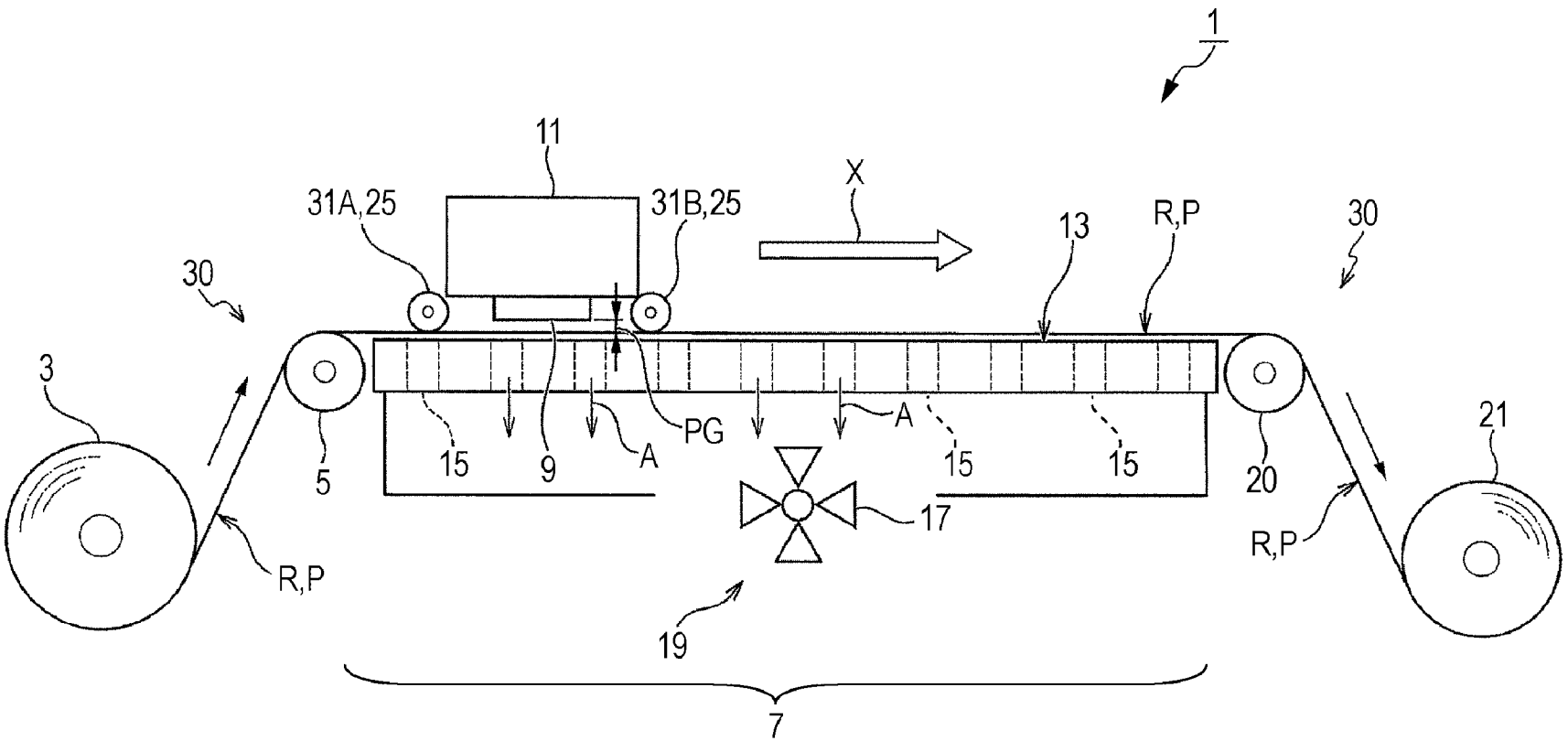
FIG. 1 is a sectional side view schematically showing an internal structure of an ink jet printer, according to the first embodiment of the invention.

The structures and operation of a recording apparatus of the invention will be described below in detail. First, as an embodiment for implementing a recording apparatus of the invention, an outline of an ink jet printer 1 will be described with reference to FIG. 1 and FIG. 2.

The ink jet printer 1 shown in the figures has a structure capable of performing a recording operation over a long recording medium P formed of a material such as a sheet of paper or a film. As the recording medium P, a rolled sheet R shown in FIG. 1 or a cut sheet P (denoted by the same reference numeral P as that of the recording medium P) shown FIG. 2 can be used.

Figure 2:
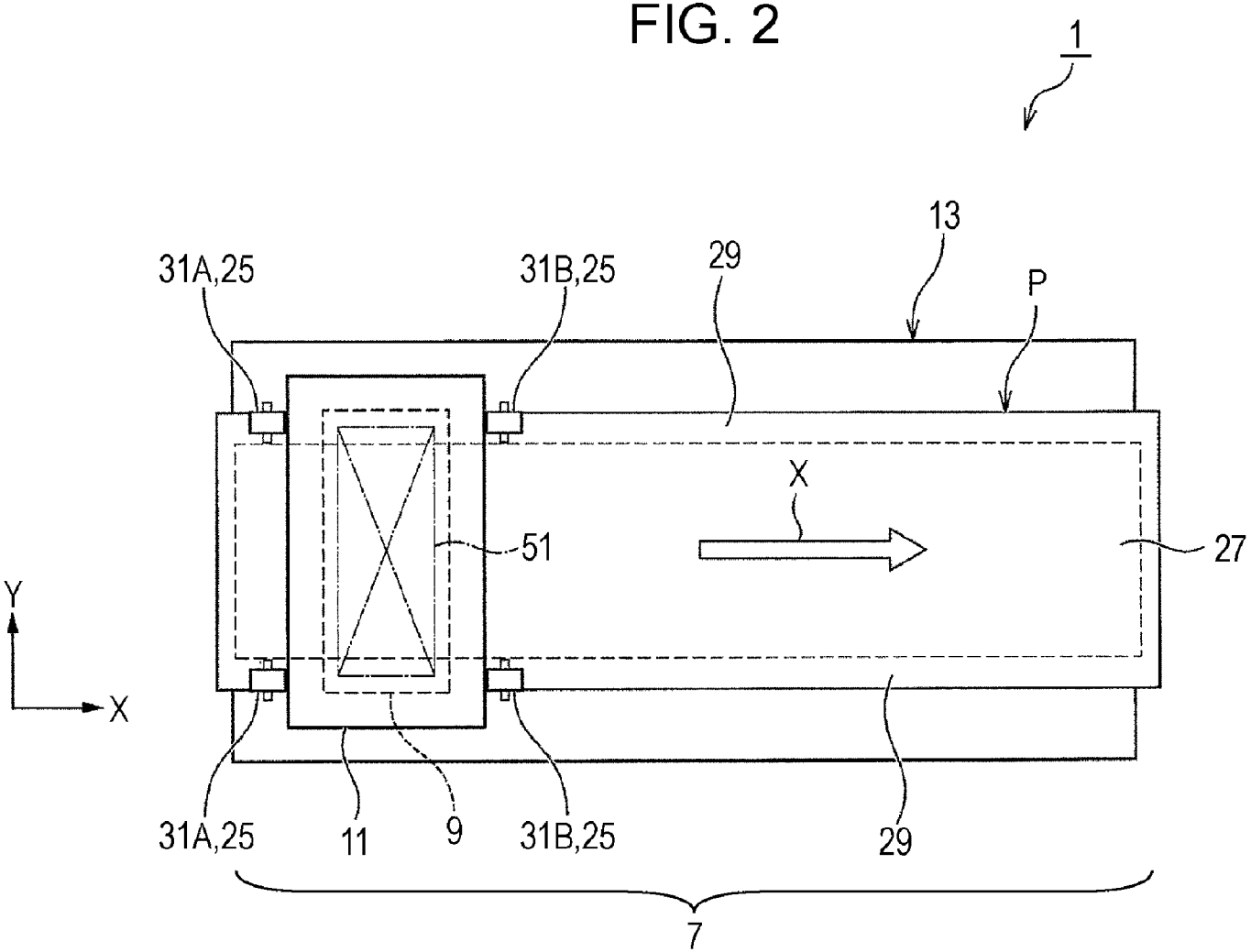
FIG. 2 is a plan view showing a recording region of the ink jet printer, according to the first embodiment of the invention.

In FIG. 1 and FIG. 2, a left side denotes an upstream side in a transport direction X of the recording medium P (hereinafter simply referred to as "upstream side"), a right side denotes a downstream side in a transport direction X of the recording medium P (hereinafter simply referred to as "downstream side"). As shown in FIG. 1, a feed section 3 for the rolled sheet R is provided at the upstream side. The rolled sheet R fed from the feed section 3 is guided by a transport guide roller 5 and is transported to a recording region 7 that is long in the transport direction X.

Above the recording region 7, there is provided a recording head 9 for performing a recording operation by ejecting inks of various colors onto an upper surface of the recording medium P, the upper surface serving as a recording surface of the recording medium P. In this embodiment, the recording head 9 is held by a carriage 11 that reciprocates in the transport direction X as a movement direction. The recording head 9 can move integrally with the carriage 11 over an entire surface of the recording region 7 that is long in the transport direction X. The carriage 11 is movably held by a carriage guide member (not shown), and a position of the carriage 11 with respect to a platen described later is defined.

Below the recording region 7, a platen 13 for supporting a lower surface of the recording medium P that reaches the recording region 7 and defining a gap PG (for example, approximately 1 mm) between the recording head 9 and the recording medium P is provided. In the platen 13, a plurality of suction holes 15, 15 . . . are formed. As an example, there is provided a suction mechanism 19 having such a structure that the recording medium P over the platen 13 is sucked to an upper surface of the platen 13 due to suction force A generated by a suction fan 17.

At a downstream side of the recording region 7, a discharging guide roller 20 is provided. The recording medium P is guided by the discharging guide roller 20 after recording has been performed. Then, when the cut sheet P serves as the recording medium P, the cut sheet P is discharged toward a discharge section (not shown). Alternatively, when the rolled sheet R serves as the recording medium P, the rolled sheet R is wound by a winding section 21 as shown in FIG. 1, or is discharged after cutting it off at a predetermined length. In the embodiment in FIG. 1, there is provided a transport section 30 having the feed section 3, the transport guide roller 5, the discharging guide roller 20, and the winding section 21 as major components.

Next, a structure of a recording apparatus 1 of the invention is described in detail mainly concerning a configuration of pressing members 25 which is a characteristic configuration of the invention used in the ink jet printer 1 configured as described above, with reference to the first to third embodiments having different structures.

First Embodiment

FIG. 1 shows a schematic internal structure of the ink jet printer 1 that is a type of a recording apparatus according to the first embodiment. In this embodiment, as shown in FIG. 2, there is adopted a structure corresponding to so-called bordered printing in which a margin 29 is formed outside a recording area 27 of a recording medium P. In addition, there are adopted a carriage 11 and a recording head 9 of a line printer system in which recording can be performed over an entire width of the recording area 27 of the recording medium P, with a single movement of the recording head 9.

A total of four pressing members 25, two pairs of the pressing members 25, are provided with respect to the carriage 11 at two positions, an upstream position and a downstream position in the transport direction X near the recording head 9. The pressing members 25 are arranged so that they are in contact with an upper surface of the margin 29 that serves as outer edge portions in a width direction Y along the recording area 27 of the recording medium P. In this embodiment, the pressing members 25 are formed by rotation bodies 31 that rotate in contact with an upper surface of the recording medium P.

Figure 3A:
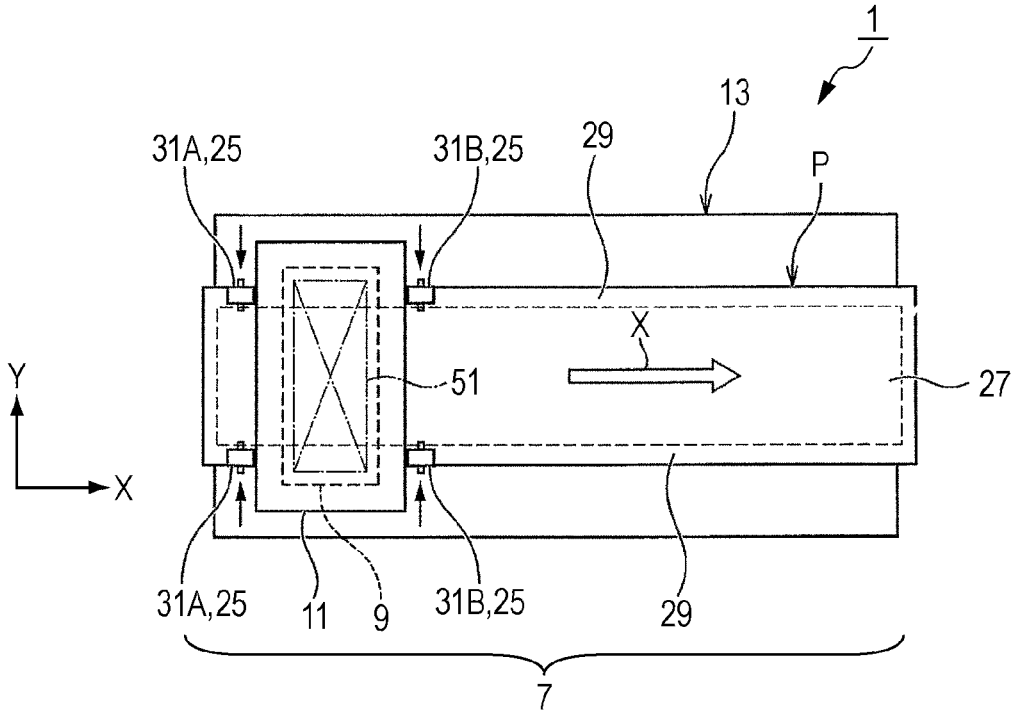
FIG. 3A is a plan view showing the recording region of the ink jet printer according to the first embodiment of the invention, when a recording medium having a smaller width is used.
Figure 3B:
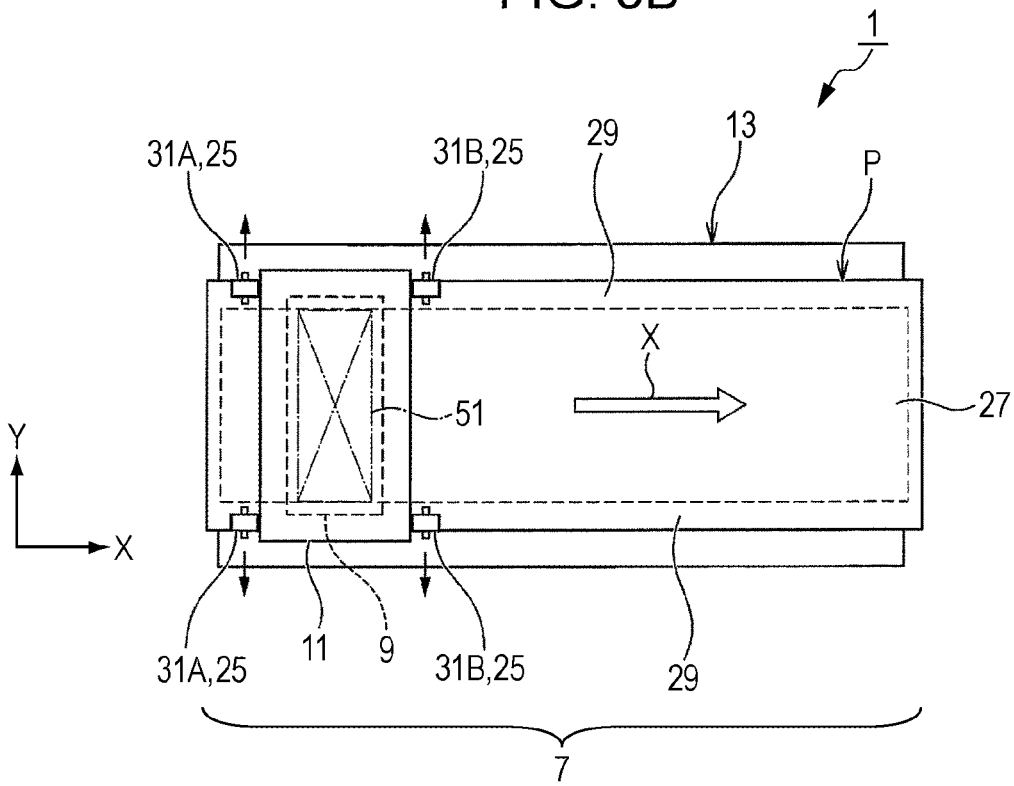
FIG. 3B is a plan view showing the recording region of the ink jet printer according to the first embodiment of the invention, when a recording medium having a larger width is used.

In addition, as shown in FIG. 3, the pressing members 25 are provided so that the positions thereof can be changed in the width direction Y of the recording medium P corresponding to differences in a width of the recording medium P. For example, when the recording medium P has a smaller width as shown in FIG. 3A, the pressing members 25 move inward. On the other hand, when the recording medium P has a larger width as shown in FIG. 3B, the pressing members 25 move outward. In this way, the pressing members 25 are configured to be positioned in the margin 29 of the recording medium P in each case.

Here, as a section for changing the positions of the pressing members 25 in the width direction Y, although not shown in the figure, there is provided an appropriate drive transmission section having a mechanism such as a link arm and a rack-and-pinion operating in conjunction with an edge guide (not shown) of a feeding section provided at an upstream side in a recording region 7, or there is provided another drive section or the like operating the pressing members 25 independently.

Here, at the upstream position and at the downstream position near the above-described recording head 9, there is included a positional relationship that a part or all of the pressing members 25 and the recording head 9 overlap each other in the width direction Y. In addition, an amount of a pressing force for correcting curling of the recording medium P is sufficient for an amount of a pressing force of the pressing members 25. Therefore, the amount of the force for supporting weights of the carriage 11 and the recording head 9 is not needed. In other words, the pressing members 25 are in contact with the recording medium P by a force smaller than the force for supporting the weights of the carriage 11 and the recording head 9.

Next, operations of the recording apparatus 1 according to the first embodiment configured as described above are described. When a leading edge of the recording medium P reaches the upstream position of the recording region 7, the leading edge of the recording medium P firstly comes in contact with rotation bodies 31A at the upstream side. Therefore, left and right edge portions that are curled upward are pressed down. In addition, with a suction action from a side of a platen 13, the recording medium P is held horizontally in close contact with an upper surface of the platen 13.

Subsequently, the leading edge of the recording medium P comes in contact with rotation bodies 31B at a downstream side. Due to the same effect as that of the rotation bodies 31A at the upstream side, the recording medium P is held horizontally in close contact with the upper surface of the platen 13. Further, a portion of the recording medium P under the recording head 9 which is interposed between the rotation bodies 31A at the upstream side and the rotation bodies 31B at the downstream side is held horizontally in close contact with the upper surface of the platen 13 due to the effects of two pairs of the rotation bodies 31A and 31B.

In this way, in a state where the recording medium P is held from above by the rotation bodies 31A and 31B and is held from below by the suction mechanism 19, a desirable recording operation is performed by moving the recording head 9 mounted on the carriage 11, for example, from the upstream side to the downstream side in the recording region 7. Accordingly, the portion of the recording medium P facing the recording head 9 is always pressed by the pressing members 25. Therefore, in the portion of the recording medium P facing the recording head 9, curling is corrected reliably and the recording medium P is held flat, so that the recording operation with high precision is performed over the entire recording surface of the recording medium P.

Further, in this way, the rotation bodies 31A and 31B are not in contact with the recording area 27 of the recording medium P subjected to the recording operation. Consequently, a high-quality recording is performed, even under a condition that an ink-fixability is poor, for example, when the recording operation is performed on the recording medium P such as a film, using water-based ink.

Moreover, by using the rotation bodies 31A and 31B that change positions thereof in the width direction Y, the same high-quality recording can be performed for a recording medium P of various sizes in the width direction.

Second Embodiment

Figure 4:
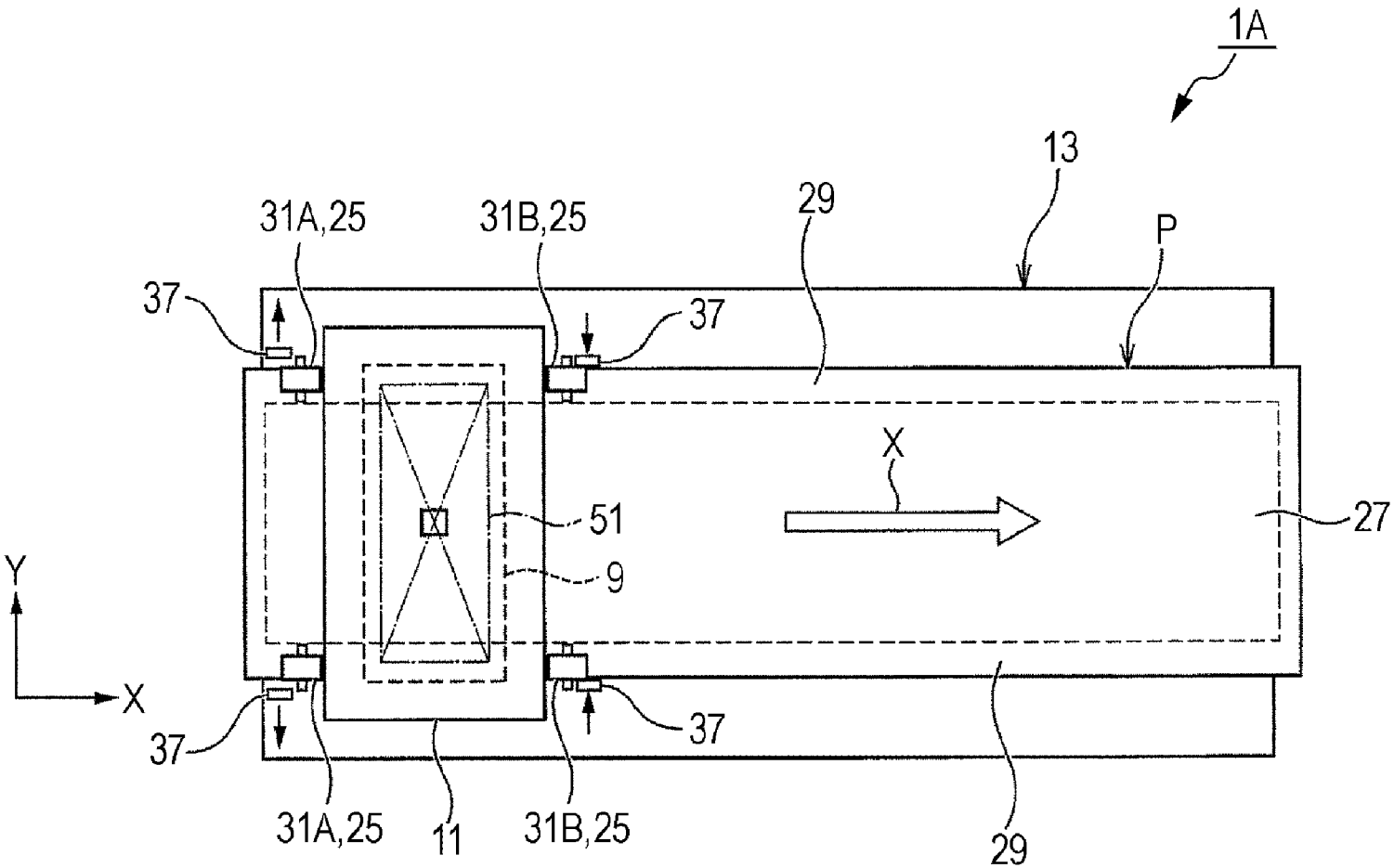
FIG. 4 is a plan view showing a recording region of an ink jet printer, according to the second embodiment of the invention.

FIG. 4 shows an ink jet printer 1A that is a type of a recording apparatus according to the second embodiment. The basic structure of the ink jet printer 1A is similar to that of the ink jet printer 1 according to the first embodiment. Consequently, the following explanations focus on structures different from those of the first embodiment.

In this embodiment, a movement direction detection sensor 35 for detecting a movement direction of the carriage 11 is provided. The current advancing direction of the carriage 11 is calculated on the basis of detection information detected by the movement direction detection sensor 35. The rotation bodies 31A and 31B are configured so that the rotation speeds thereof can be adjusted so as to cause the rotation bodies 31A and 31B to rotate later on a front side in the advancing direction of the carriage 11, and rotate earlier on a rear side. As a section for adjusting the rotation speeds of the rotation bodies 31A and 31B, a known controller 37 using a disk brake, a brake pad, an air damper, and the like can be used, although not shown in the figure.

By using the movement direction detection sensor 35 and the controller 37, a state in which the recording medium P is under tension is maintained between the rotation bodies 31A provided at the upstream side near the recording head 9 and the rotation bodies 31B provided at the downstream side near the recording head 9. Therefore, the quality of the recording operation of the recording medium P is maintained by preventing not only lifting of the recording medium P caused by curling of the recording medium P but also lifting of the recording medium P caused by the balance between the rotation speeds of the two pairs of the rotation bodies 31A and 31B.

Third Embodiment

Figure 5:
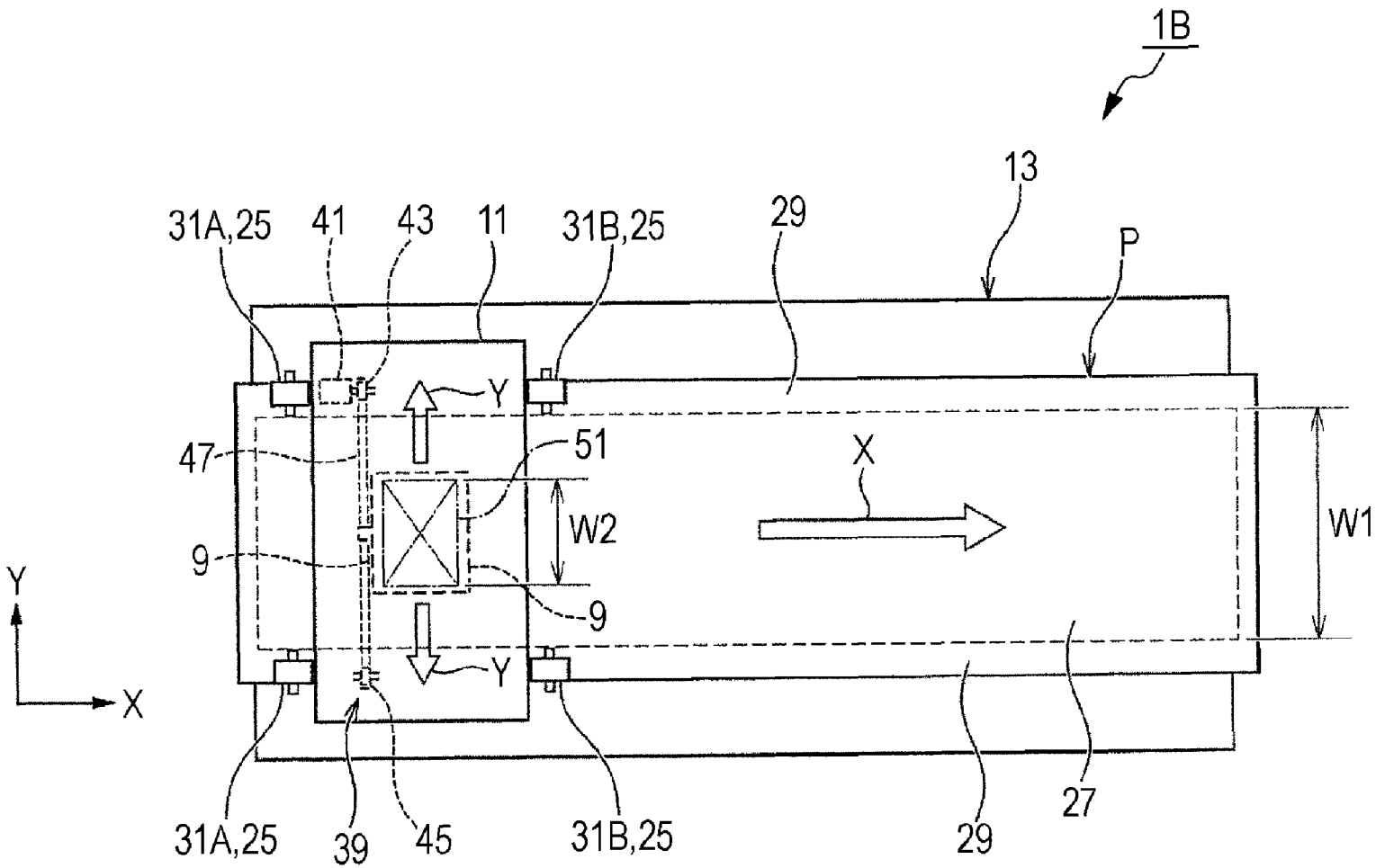
FIG. 5 is a plan view showing a recording region of an ink jet printer, according to the third embodiment of the invention.

FIG. 5 shows an ink jet printer 1B that is a type of a recording apparatus according to the third embodiment. The basic structure of the ink jet printer 1B is similar to that of the ink jet printer 1 according to the first embodiment. Consequently, the following explanations focus on structures different from those of the first embodiment.

In this embodiment, the recording head 9 is provided with respect to the carriage 11 so as to change a position thereof in the width direction Y of the recording medium P. As a mechanism 39 for changing the position of the recording head 9 in the width direction Y, various mechanisms can be used. For example, as shown in the figure, a mechanism including a drive roller 41, a drive pulley 43, a driven pulley 45, and a toothed belt 47 having an endless band shape can be used, the toothed belt 47 being wound around the drive pulley 43 and the driven pulley 45.

In the case that the mechanism 39 for changing the position of the recording head 9 is used, when a width W1 of the recording area 27 of the recording medium P is larger than a width W2 of an ink ejection area 51 of the recording head 9 as shown in FIG. 5, the recording head 9 is moved by a predetermined stroke in the width direction Y of the recording medium P regardless of the movement of the carriage 11, therefore, the recording operation is performed over an entire surface of the recording area 27 of the recording medium P.

Other Embodiments

A recording apparatus 1 of the invention basically has the above-described configurations. However, the configurations can be changed or omitted partly without departing from the gist of the invention.

Figure 6:
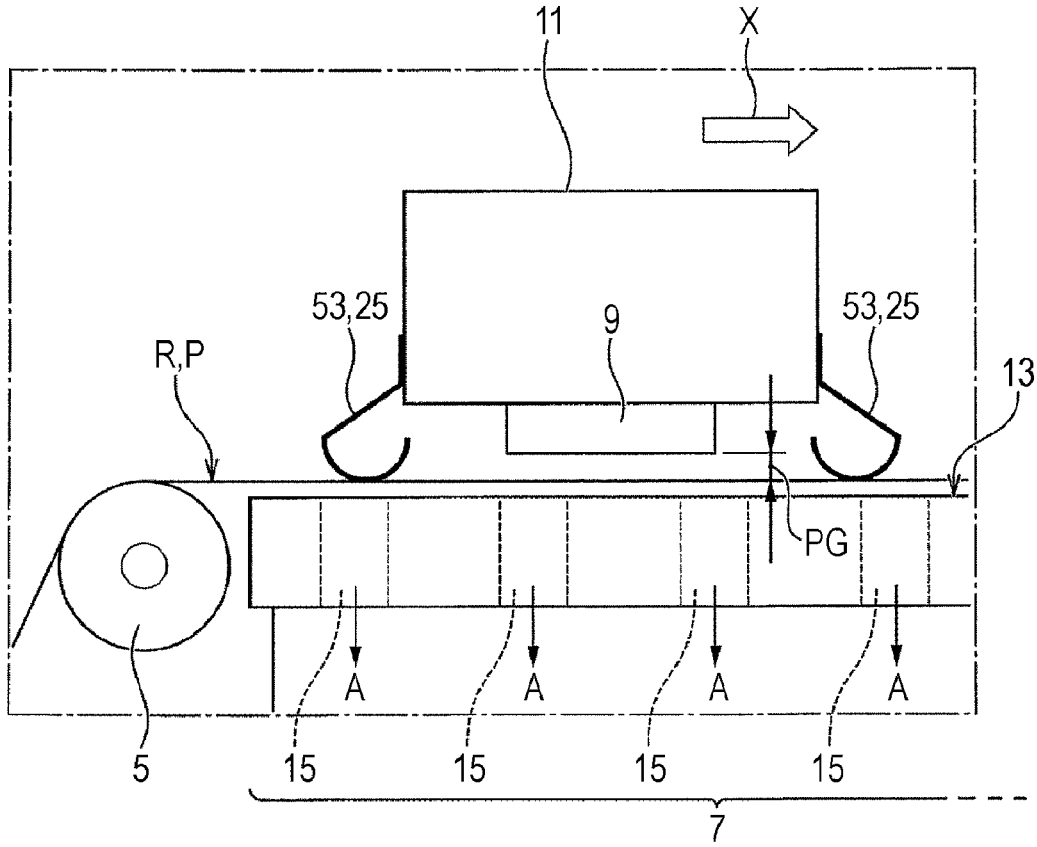
FIG. 6 is a sectional side view showing pressing members of an ink jet printer on an enlarged scale, according to another embodiment of the invention.

For example, as shown in FIG. 6, as the pressing members 25, curved plate spring members 53, spherical bodies (not shown) or the like other than the rotation bodies 31 used in the first to third embodiments can be used.

Figure 7:
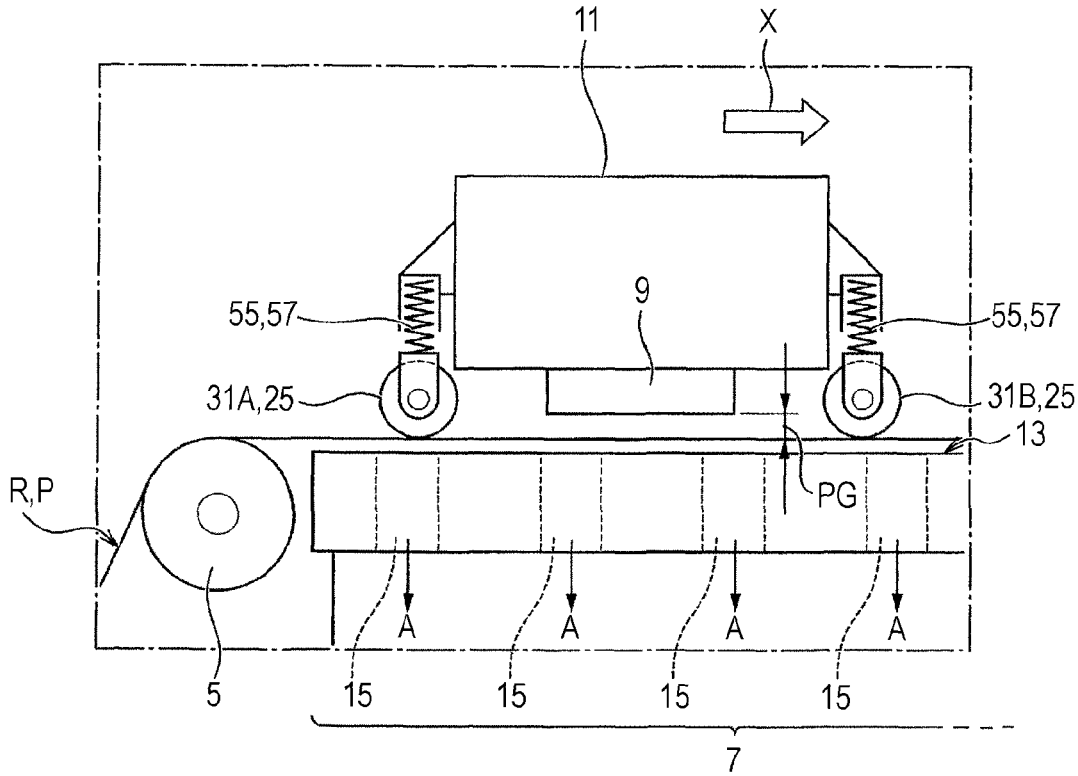
FIG. 7 is a sectional side view showing pressing members of an ink jet printer on an enlarged scale, according to yet another embodiment of the invention.

Further, for example, as shown in FIG. 7, a vibration proof mechanism 57 including spring members 55 for a suspension provided with respect to the pressing members 25 can be used in order to prevent transmission of vibration from a side of the recording medium P to a side of the recording head 9.

In addition, the pressing members 25 can be used in an ink jet printer in which the carriage 11 moves in a direction intersecting the transport direction X, and in a so-called line printer in which the recording head 9 fixed by a fixing member does not move.

Further, when the pressing members 25 are configured to be capable of changing positions thereof in the width direction Y, a user can position at an appropriate position based on a center of the recording medium P or one side of the edge, corresponding to a movement of the edge guide or the like provided in the feeding section. Further, it is possible to change the number and arrangement of the pressing members 25 suitably.

What is claimed is:

1. A recording apparatus comprising:

a recording head for performing a recording operation by ejecting ink onto a recording surface of a recording medium while moving;

a transport section for transporting the recording medium along a transporting path that passes through a recording region in which the recording head performs the recording operation;

a platen located in the recording region for supporting a surface opposite the recording surface of the recording medium; and pressing members located in a margin region of the recording region and being in contact with outer edge portions in a width direction of the recording surface of the recording medium so as to press the outer edge portions while not pressing the portion of the recording surface that receives the ejected in, the outer edge portions being located in the margin region;

wherein the pressing members move so as to press the recording medium at an upstream side and at a downstream side of the recording head, with a movement of the recording head.

2. The recording apparatus according to claim 1, wherein the recording head is held by a carriage reciprocating in a transport direction of the recording medium, and the pressing members are provided near the recording head at least two positions, an upstream position and a downstream position in the transport direction of the recording medium.

3. The recording apparatus according to claim 2, wherein the pressing members are held by the carriage and are in contact with the recording medium by a force smaller than a force supporting a weight of the carriage.

4. The recording apparatus according to claim 1, wherein the pressing members serve as rotation bodies that rotate in contact with the outer edge portions of the recording medium.

5. The recording apparatus according to claim 4, wherein the rotation bodies are configured so that the rotation speeds thereof can be adjusted so as to cause the rotation bodies to rotate later on a front side in an advancing direction of the carriage, and rotate earlier on a rear side.

6. The recording apparatus according to claim 1, wherein a suction mechanism for sucking and holding the recording medium that reaches the recording region is provided for the platen.

7. The recording apparatus according to claim 1, wherein a vibration proof mechanism for preventing transmission of vibration from a side of the recording medium to a side of the recording head is provided for the pressing members.

8. A recording apparatus comprising:

a recording head for performing a recording operation by ejecting ink onto a recording surface of a recording medium while moving;

a transport section for transporting the recording medium along a transporting path that passes through a recording region in which the recording head performs the recording operation;

a platen located in the recording region for supporting a surface opposite the recording surface of the recording medium; and pressing members located in the recording region and being in contact with outer edge portions in a width direction of the recording surface of the recording medium;

wherein the pressing members move so as to press the recording medium at an upstream side and at a downstream side of the recording head, with a movement of the recording head, wherein the pressing members serve as rotation bodies that rotate in contact with the outer edge portions of the recording medium.

9. A recording apparatus comprising:

a recording head for performing a recording operation by ejecting ink onto a recording surface of a recording medium while moving;

a transport section for transporting the recording medium along a transporting path that passes through a recording region in which the recording head performs the recording operation;

a platen located in the recording region for supporting a surface opposite the recording surface of the recording medium; and pressing members located in the recording region and being in contact with outer edge portions in a width direction of the recording surface of the recording medium;

wherein the pressing members move so as to press the recording medium at an upstream side and at a downstream side of the recording head, with a movement of the recording head, wherein the recording head is held by a carriage reciprocating in a transport direction of the recording medium, and the pressing members are provided near the recording head at at least two positions, an upstream position and a downstream position in the transport direction of the recording medium, wherein the pressing members are held by the carriage and are in contact with the recording medium by a force smaller than a force supporting a weight of the carriage.

10. A recording apparatus comprising:

a recording head for performing a recording operation by ejecting ink onto a recording surface of a recording medium while the recording head and the recording medium relatively move in a transport direction;

a transport section for transporting the recording medium along a transporting path that passes through a recording region in which the recording head performs the recording operation; and a pressing member for pressing the recording medium on a part of a region which extends in the transport direction and is other than the recording region.

11. The recording apparatus according to claim 10, wherein the pressing members move so as to press the recording medium at an upstream side and at a downstream side of the recording head, with a movement of the recording head.

12. The recording apparatus according to claim 10, wherein the part of the region is in outer edge portion of the recording medium which is located in a width direction of the recording surface of the recording medium.

* * * * *